US006401738B1

(12) United States Patent
Alexander

(10) Patent No.: US 6,401,738 B1
(45) Date of Patent: Jun. 11, 2002

(54) COLLAPSIBLE POWER GAIT WALKER INCLUDING A CLIMBING AND DECLINING MECHANISM

(76) Inventor: Larry Rush Alexander, 2306 Central St., Apt. 2N, Evanston, IL (US) 60201

( * ) Notice: Subject to any disclaimer, the term of this patent is extended or adjusted under 35 U.S.C. 154(b) by 0 days.

(21) Appl. No.: 09/639,490

(22) Filed: Aug. 15, 2000

Related U.S. Application Data

(63) Continuation-in-part of application No. 09/502,755, filed on Feb. 11, 2000, now Pat. No. 6,338,354.

(51) Int. Cl.[7] ..... A61H 3/00

(52) U.S. Cl. ..... 135/67; 135/74; 135/76; 297/6; 297/344.18; 297/440.24

(58) Field of Search ..... 135/62, 74, 76, 135/66; 297/5, 6, 440.22, 440, 24, 452, 2, 338, 344.18; 280/647, 655.1; 403/84, 116, 117, 108, 325, 327

(56) References Cited

U.S. PATENT DOCUMENTS 3,658,079 A * 4/1972 Block ..... 135/45 A
3,945,389 A * 3/1976 Smith ..... 135/45 A
3,993,088 A * 11/1976 Thomas ..... 135/67
4,643,211 A * 2/1987 Morris et al. ..... 135/67
4,729,395 A * 3/1988 Adamson ..... 135/67
4,830,035 A * 5/1989 Liu ..... 135/67
5,188,139 A * 2/1993 Garelick ..... 135/67
5,201,333 A * 4/1993 Shalmon et al. ..... 135/67
5,433,235 A * 7/1995 Miric et al. ..... 135/67
5,529,425 A * 6/1996 Spies et al. ..... 403/322
5,882,067 A * 3/1999 Carbajal et al. ..... 297/6
5,979,476 A * 11/1999 Cranny ..... 135/67
6,206,019 B1 * 5/2001 Horvitz ..... 135/74

* cited by examiner

*Primary Examiner*—Carl D. Friedman
*Assistant Examiner*—Yvonne M. Horton
(74) *Attorney, Agent, or Firm*—McAndrews, Held & Malloy, Ltd.

(57) ABSTRACT

An orthopedic walker having a rear crossbar which is pivotally mounted to two side frames allowing for sequential movement of one side frame forward relative to the other to facilitate walking. A pair of wrist guards are positioned at the top of each frame and the frames provide a smooth transitioning of a number of handholds to aid in standing from a seated position. A pair of climbing members are also positioned on ribs along a left side frame and a right side frame.

17 Claims, 6 Drawing Sheets

COLLAPSIBLE POWER GAIT WALKER INCLUDING A CLIMBING AND DECLINING MECHANISM

This application is a CIP of Ser. No. 09/502,755, filed Feb. 11, 2000 now U.S. Pat. No. 6,338,354.

BACKGROUND OF THE INVENTION

The invention relates to a collapsible orthopedic walker, and more particularly to a rear crossbar articulated walker.

Traditional walkers have enabled people with reduced use of their legs to walk. However, there are features of these traditional walkers that are not optimal.

For example, the front crossbar design of a traditional walker greatly reduces the length of a person's gait. The gait is the measured distance covered by a person in one or more steps. While a user may have a reduced gait already due to an injury or affliction, the user never has the opportunity to graduate to full gait length with a traditional walker.

In addition, the single-button collapsible feature of the traditional walker is not ideal. The purpose of the single-button feature is to allow the user to simply press one button to collapse the walker. Both legs then fold inwardly, to create a spatially reduced structure that can be stored in the back of a car, restaurant, movie theater, etc. A common complaint regarding single-button collapsibility is the fact that both legs must be collapsed and not one only. This hinders users from being able to collapse a single side leg to navigate through a narrow doorway, for example.

In addition, a traditional walker does not have a standing aid. Without an aid, a user finds it difficult, and sometimes impossible, to get up from a seated position without the help of an outside source. This is particularly awkward in a more private atmosphere, such as a restroom.

In addition, the ergonomics of traditional walkers are not optimal. There is a need for a better interface between the handles of the walker and the user's hands.

In view of these problems, some improvements have been made by others to the traditional walker. For example, the walker has been modified to provide a standing aid. A "stair-step" approach has been added to the handgrip area in order to provide a lower handgrip disposed subjacent to the standard handgrip. This two-step approach allows the user to "march" up, one handle grip at a time, in order to rise to a standing position. However, this requires increased upper-body strength for the user to be able to maneuver himself to a standing position.

Therefore, it is an object of the present invention to provide an improved light-weight stable walker.

It is yet another object of the present invention to provide a walker with a standing aid to permit a user to easily stand from a sitting position.

It is yet another object of the present invention to provide a walker that will facilitate toilet use.

It is another object to provide a walker that may be used both indoors and outdoors.

It is another object of the present invention to provide a collapsible walker for storage and travel.

It is another object of the present invention to provide a walker that can be partially collapsed to help the user safely navigate through a narrow doorway.

It is another object of the present invention to provide a walker for people who need a transition between a wheel-chair and walking.

It is another object of the present invention to provide a walker without a front crossbar.

It is yet another object of the present invention to provide a walker that easily permits the user to climb and descend along the walker, for example to or from a seated position.

SUMMARY OF THE INVENTION

These and other objects of the invention are achieved in a walker having a pair of side frame members and a rear crossbar member. The crossbar member is pivotally mounted for independent movement relative to each of the side members. Climbing members are positioned along the left and right side frames to permit the user to raise him or herself from a seated position or lower him or herself into a seated position

DETAILED DESCRIPTION OF THE PREFERRED EMBODIMENT

Figure 1:
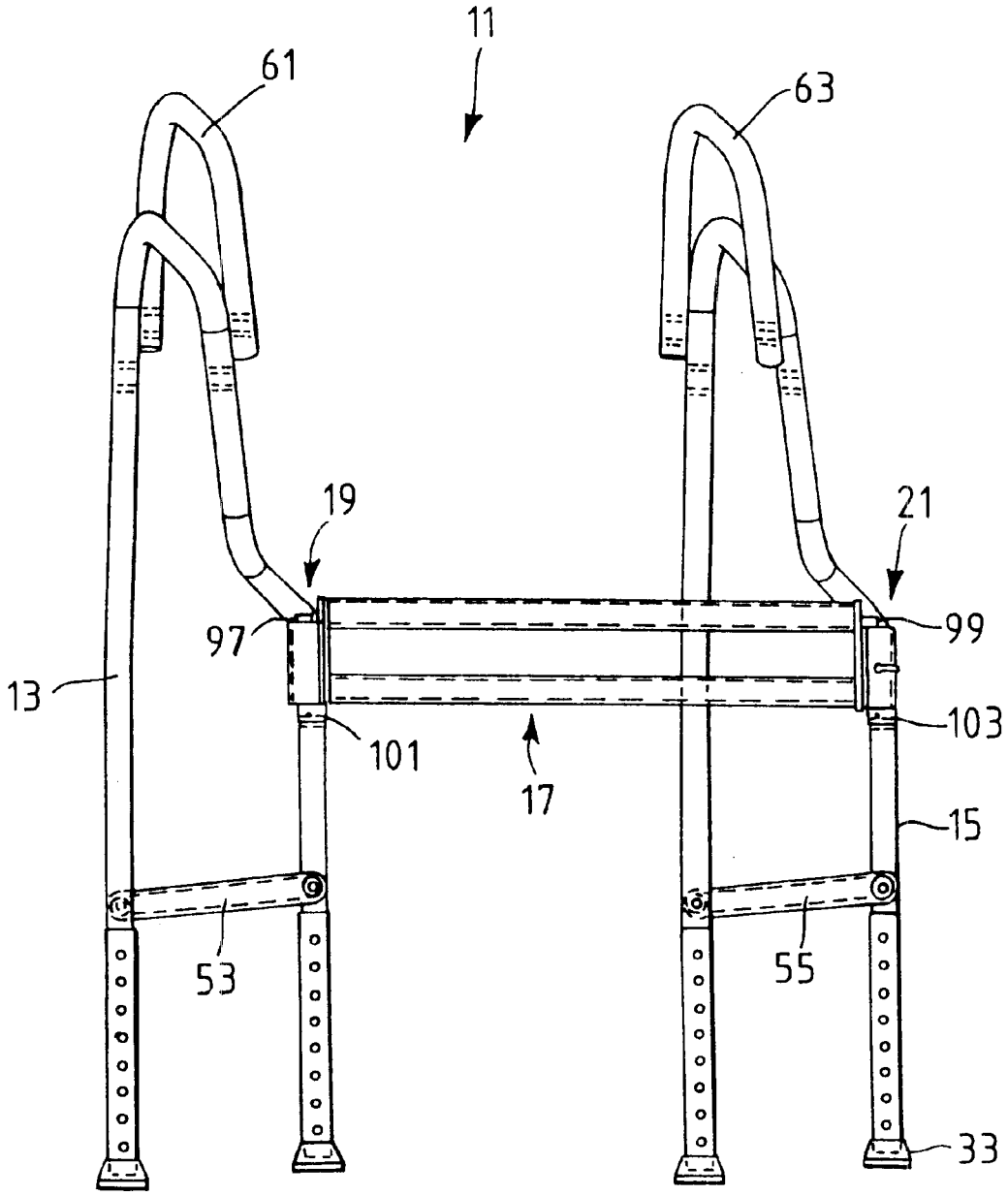
FIG. 1 is a perspective view of a walker according to the present invention.

Referring to FIG. 1, a walker 11 is constructed from a left side frame 13, a right side frame 15 and a rear crossbar 17. Crossbar 17 has one end 19 pivotally connected to left side frame 13 and another end 21 pivotally connected to right side frame 15. Side frames 13, 15 are generally identical (mirror images), as shown.

Figure 2:
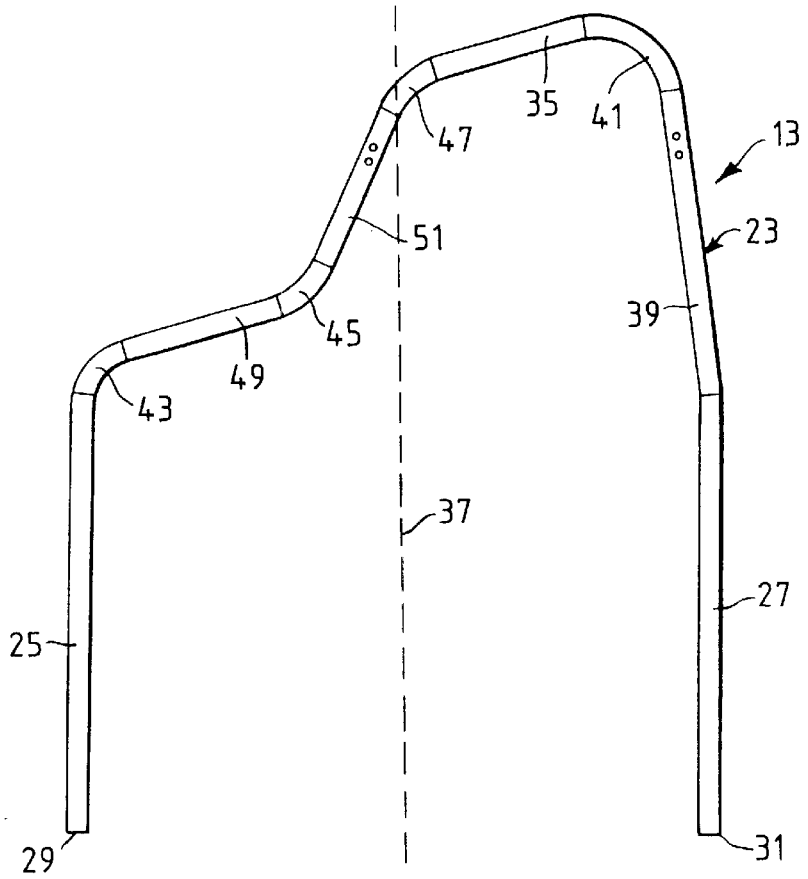
FIG. 2 is a side view of the left side frame of the walker of FIG. 1.
Figure 3:
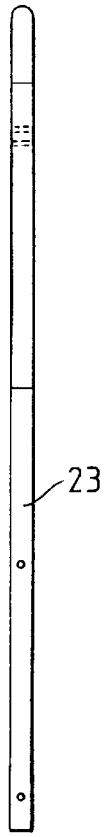
FIG. 3 is an end view of the left side frame of FIG. 2.

Referring to FIGS. 2 and 3, left side frame 13 is formed from a hollow light-weight cylindrical tube 23 which is bent to the shape shown in FIG. 2. Bending may begin with the backside of the frame working forward. Tube 23 also may be cut and plugged together in a conventional manner to facilitate bending.

Frame 13 is preferably planar, lying within the planes defined by the outside and inside surfaces of tube 23, as shown in FIG. 3. The preferred tube 23 is made from aluminum or other metal alloys or plastics, for example, to be lightweight and has an outside diameter of one inch.

Frame 13 includes a linear rear leg portion 25 and a linear front leg portion 27. Each leg portion 25, 27 terminates in a respective support end 29, 31. End 31 provides a flat surface for making supporting contact with the floor during a walking maneuver of walker 11. End 29 preferably provides a convex curvilinear surface for making supporting contact with the floor, in a rocking-type motion similar to a rocking chair, for ease of forward advancement during a walking maneuver. As will suggest itself, ends 29, 31 may be capped with a rubber tip or cup 33 (FIG. 1) to provide a non-slip surface. The curvilinear surface of end 29 may be achieved through shaping either the end 29, the cup 33 or both. Leg portions 25, 27 are twenty (20) inches in length and are spaced apart in a substantially parallel relationship by a distance of twenty-nine (29) inches center to center.

A main hand grip portion 35 is a linear section of the tube 23, approximately 7.28 inches long. Portion 35 is located forward, to the front, of the centerline 37 of the frame, and disposed at an acute angle with the floor (or horizontal)

Hand grip portion 35 is supported by a linear section 39 and a curved section 41 of tube 23 connected between front leg portion 27 and hand grip portion 35. Three curved sections 43, 45, 47 and two linear sections 49, 51 are connected between rear leg portion 25 and hand grip portion 35. As will suggest itself other shapes of tube 23 may be used to dispose grip portion 35 relative to leg portions 25, 27.

The sections 43–51 provide a smooth upwardly increasing section of tube 23 to provide a plurality of hand holding areas or handles to permit the user to get up from a seated position. Linear sections 49 of the two frames provide a set of low handles or handholds where the user may grip the walker initially when seating himself in order to lower himself or herself onto a seat or a toilet. In performing this seating maneuver, the user, while standing, merely moves or slides his or her hands down to handles 49. Once the user's hands are in place on handles 49, the user bends his knees to a sitting position. To stand, the user may place his or her hands on handles 49, to raise himself or herself upwardly an incremental amount, and then move his/her hands in sequence (left, right, left, right, etc.) along handle sections 51 and finally to hand grip portion 35 to complete the standing maneuver. Handle section 51 has a greater angle to the floor than handle sections 49, 35.

The low handle sections 49 also. preferably facilitate placement of the walker over or around a toilet seat while the low handles 49 remain out of the way of (I.e., beneath) a water tank attached to the toilet seat. In this way, the user may back the walker right on top of a toilet seat without having to leave the walker and step over to the toilet. Instead, the user simply backs the walker right over the toilet.

Each leg portion 25, 27 may be telescopically extendable in order to lengthen leg portions 25, 27 so as to adjust the height of the walker with respect to the height of the user. Extending or shortening leg portions 25, 27 adjusts the height of hand grip portion 35 to a comfortable position.

As shown in FIG. 1, the front and rear leg portions of each frame 13, 15 are joined by a respective side crossbar 53, 55. Side crossbars 53, 55 are disposed parallel to the floor or horizontal.

The ends of crossbars 53, 55 are cut out in a radius for mating with the outside cylindrical surface of leg portions 25, 27. A press fit plug (not shown) may be placed in each end of a side crossbar 53, 55 to permit securement of the crossbars to the leg portions 23, 25. A bolt (not shown) passes through a respective side frame and into an axially threaded hole (not shown) in the plug of the side crossbar. Other securement means may be used including nuts and washers, welding, etc.

Referring again to FIG. 1, a pair of identical wrist guards 61, 63 are connected respectively to sides 13, 15. The wrist guards support the inside of the wrists when the user is gripping the hand grip portions.

Figure 4:
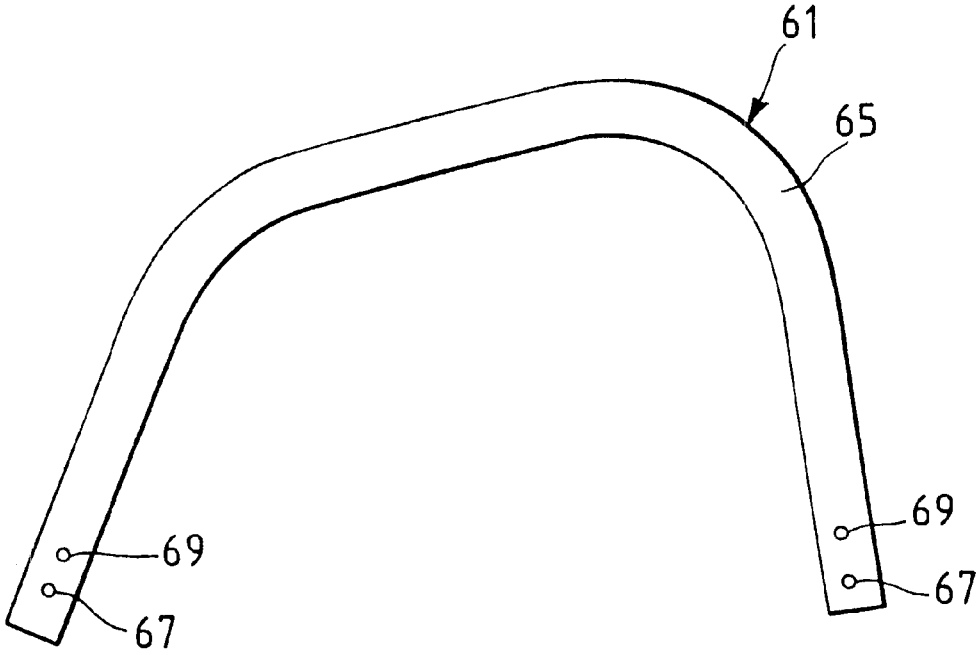
FIG. 4 is a side view of a wrist guard of the walker of FIG. 1.
Figure 5:
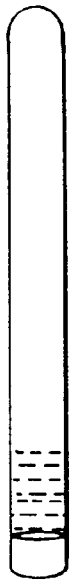
FIG. 5 is an end view of the wrist guard of FIG. 4.

As shown in FIG. 4, each wrist guard 61, 63 is preferably formed from a hollow light weight cylindrical tube 65 made of aluminum or other metal alloys or plastics, for example, and having an outside diameter equal to that of tube 23. Tube 65 is bent in the shape shown. Each wrist guard 61, 63 is generally planar lying within the planes defined by the outside and inside surfaces of tube 65, as shown in FIG. 5. Two sets of a pair of holes 67, 69 pass through each end of wrist guards 61, 63 for receiving bolts (not shown) to secure guards 61, 63 either to the inside or outside surface of frames 13, 15. Nuts and washers (not shown) may be used on the other side of the bolt. As will suggest itself, the two ends of the wrist guard may be flattened for a conforming fit against the cylindrical surface of the frame, in the area where guards 61, 63 contact the frame. During use, the wrist guards 61, 63 make contact with the interior portion of the user's wrists. This provides a greater stability for the user while he or she is using the walker. This may allow for a user with a relatively strong upper body (such as, for example, an athlete recovering from a lower body injury or paraplegic to support his or her entire body weight using just his or her hands and wrists.

Figure 6:
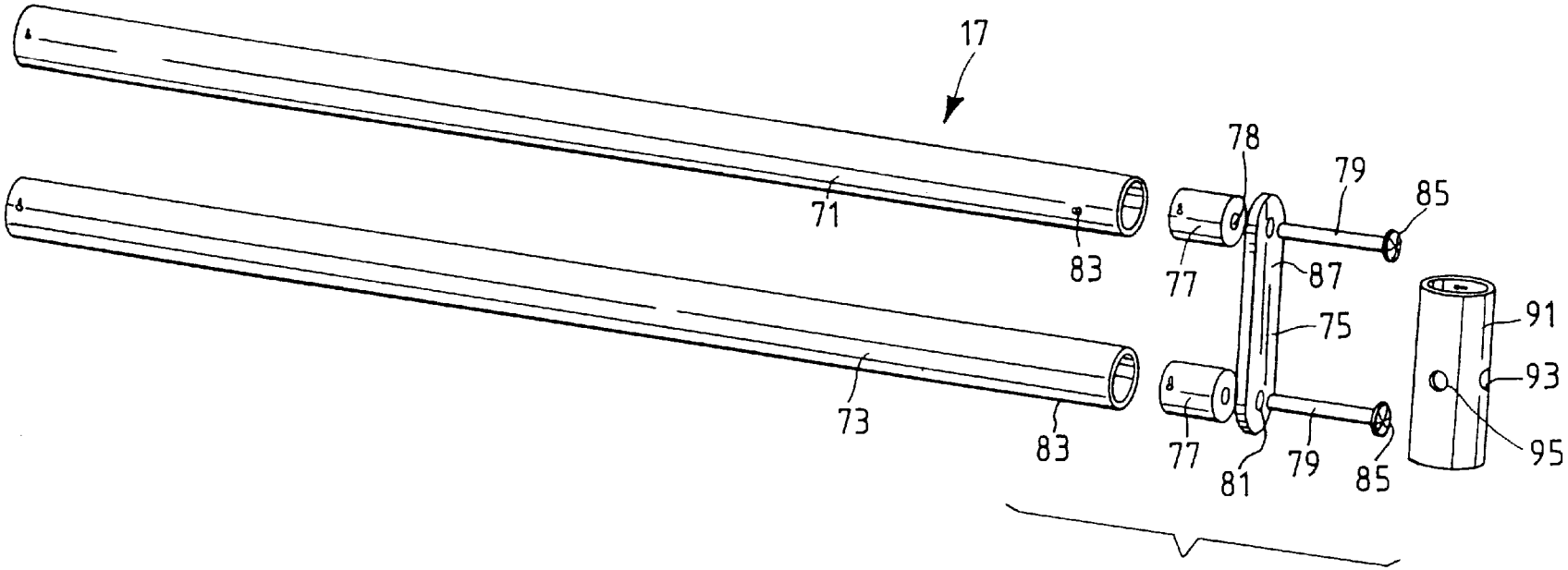
FIG. 6 is a perspective view of the rear crossbar of the walker of FIG. 1.
Figure 7:
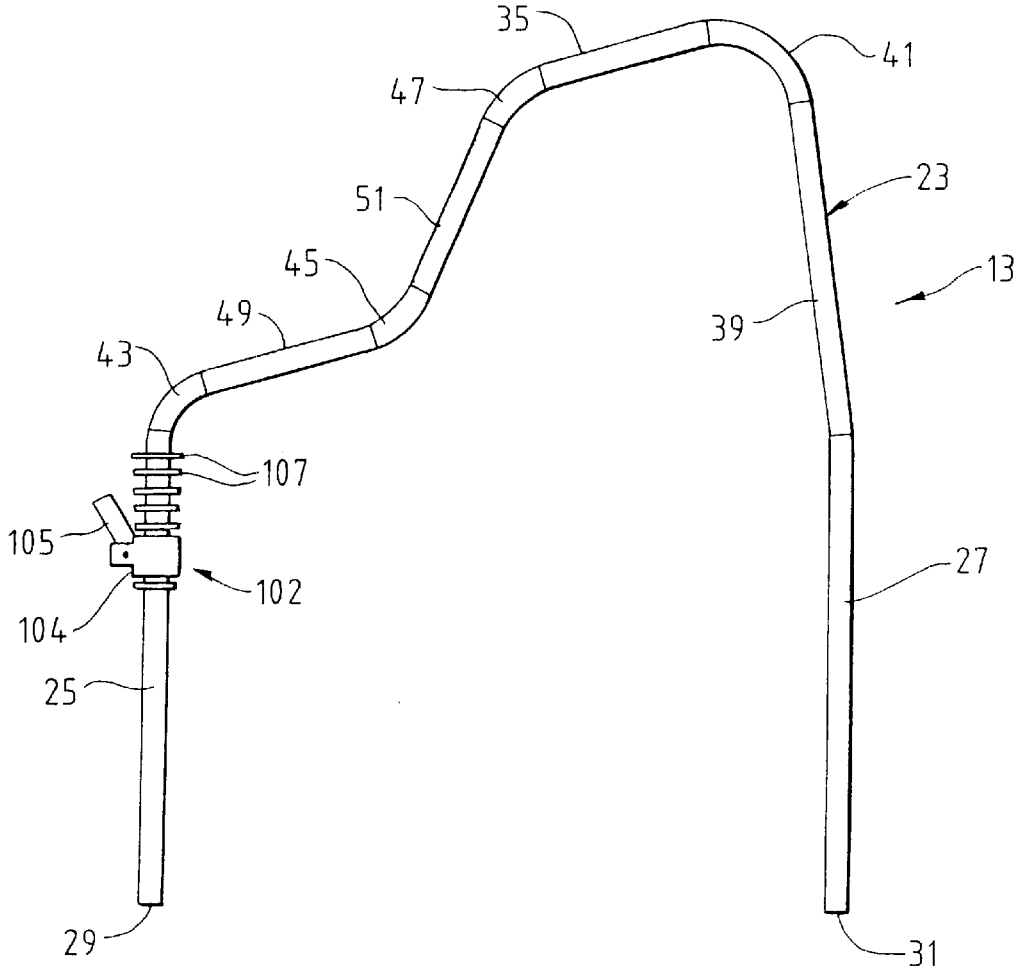
FIG. 7 is a side view of the left side frame according to a particular embodiment of the invention.
Figure 8:
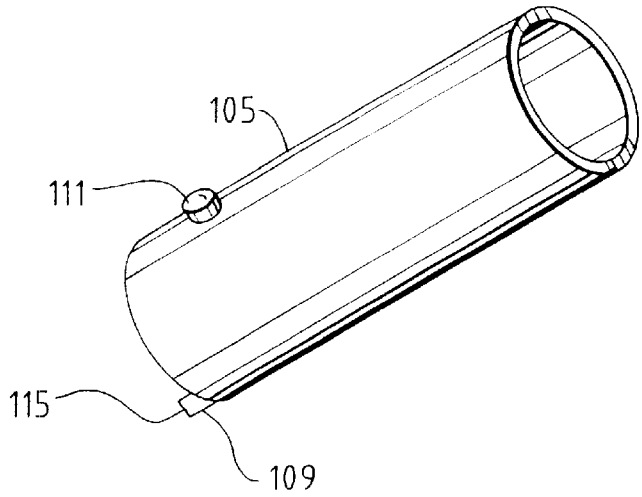
FIG. 8 is a side view of a handle member according to a particular embodiment of the invention.

Referring to FIG. 6, rear crossbar 17 includes a pair of linear cylindrical tubes 71, 73 held in a parallel spaced apart relationship by a spacer plate 75 placed at the two lateral ends of the tubes. Each tube 71, 73 is 20.5 inches in length. A plug 77 is press fit into each of the four ends of the two tubes 71, 73. Each plug 77 has a threaded hole 78 for receiving a threaded bolt 79. A pair of spacer plates 75 (one shown) are secured to the ends of tubes 71, 73. Each one of four bolts 79 pass through a hole 81 in spacer plate 75 and into a plug 77. Holes 81 in spacer plate 75 are countersunk so that the heads 85 of bolts 71 lie flush with the top surface 87 of spacer plates 75. A hole 83 is bored in each end of tubes 71, 73 for receiving a screw (not shown) or the like to secure the plug 77 in position within tubes 71, 73.

A pair of cylindrical hinge tubes 91 (one shown in FIG. 6) is welded to each spacer plate 75. The axis of tube 91 is disposed parallel to the top surface 87 of plate 75 and in the plane defined by the axes of tubes 71, 73.

Hinge tube 91 is three inches in length and has an inner diameter of slightly larger than one inch so as to receive frame tube 23 in a rotatable or pivotal manner. The cylindrical hinge tubes 91 preferably have a slightly larger diameter than the diameter of legs 25, 27 such that a low friction sleeve (for example, a teflon plastic sleeve) (not shown) can be press fit between the tubes 91 and legs 25, 27. These sleeves are intended to allow vertical and pivotal movement of rear crossbar 17, as will be further discussed below. As shown in FIG. 1, hinge tube 91 is located on the linear rear leg portion of tube 23 of each side frame 13, 15. Left side frame 13 pivots or rotates within one hinge tube 91 allowing rotation of left side frame 13 relative to rear crossbar 17. Right side frame 15 pivots or rotates within the other hinge tube 91 allowing rotation of the right frame 15 relative to rear crossbar 17. Thus, one side frame may be pivoted independently of the other side frame, thereby permitting the user to collapse one side frame 13 or 15 independently of the other to navigate through narrow passageways, such as narrow doorways.

Each hinge tube includes a pair of button holes 93, 95 5/16 inches in diameter. Button holes 93, 95 of left hinge tube 91 have their centers disposed at 87.2 degrees relative to each other. Button holes 93, 95 of right hinge tube 91 have their centers disposed at 92.8 degrees. A spring loaded button (not shown) may be mounted within tube 23 in a position for movement outwardly into button holes 93, 95 when the respective side frame is at a predetermined angle with respect to crossbar 17. This allows the side frames to be locked in a conventional walking position where the crossbar is substantially perpendicular to each side frame. The user may press the locking buttons inwardly to allow one or both of the frames to pivot. By adjusting the height of the crossbar, the user may avoid the locking buttons entering the button holes to allow both side frames to freely pivot. This allows for an articulated movement of the walker as the user moves in ordered steps one step following the next. As the user moves his or her left foot forward, he or she lifts and moves the left side frame 13 forward keeping his or her weight on the right frame 15 which is not moved. The rear crossbar 17 pivots on both frames 13, 15 as this first step is taken. The user then shifts his or her weight to the left frame 13 and moves his or her right foot forward. As the user moves his or her right foot forward, he or she lifts and moves the right side frame 15 forward keeping his or her weight on the left frame 13 which is not moved.

The manner of use described immediately above is an ipsolateral use. The user may also use the walker in a contralateral manner, i.e. moving his or her right arm forward (along with the right frame 15) while moving his or her left leg forward. Thus, the walker may be used either ipsolaterally or contralaterally.

Referring again to FIG. 1, two pairs of cylindrical hinge vertical stops 97, 99, 101, 103 are disposed on rear leg portion 25, both above and below hinge tubes 91. Stops 97–103 have an inside diameter of approximately one inch for freely receiving leg portion 25. A pair of threaded holes (not shown) pass through stops 97–103, for receiving a threaded screw to secure the stops tightly to the frame in a desired position. This constrains the vertical position of crossbar 17.

The stops 97, 99 are preferably placed at a height which allows the crossbar 17 to clear the top of a toilet seat as the user backs the walker over the seat. Stops 101, 103 are preferably placed at a height which allows the crossbar 17 to be placed below the level of the seating portion of a chair, couch or bench. In this manner, the user may back into a seating position on a chair or the like without the rear crossbar 17 interfering with the user's legs.

In addition, the walker may be collapsed for storage. One side frame may be pivoted 90 degrees against the inside of crossbar 17. The other side frame may be pivoted 270 degrees against the outside of crossbar 17. Locking buttons and locking holes on hinge tube 91 may serve to lock the walker in its collapsed position.

Turning now to FIGS. 7–10, the walker may also include a climbing member 102 on two or more of the walker's legs. This climbing member 102 permits the user to raise him or herself from a seated position or lower him or herself into a seated position. The climbing member 102 includes a coupling member 104 and a handle member 105. The handle member 105 includes a tongue 109 adapted to be inserted between ribs 107 along one of the legs. The hand also includes a pivot point 111 for pivotal attachment to the coupling member 102. The coupling member 104 also includes a pivot receiving point 113. In this way, the handle 105 may pivot about the pivot point 111 during use, as illustrated by the dotted lines in FIG. 10.

For example, with both handles starting in a horizontal position, the user places his or her right hand around the handle on the lower part 25 of the right leg 15 and his or her left hand around the handle on the lower part 25 of the left leg 13. The user then lifts the right handle from the horizontal and moves the tongue 109 and handle 105 upward. While lifting the right handle 105 upward, the user may place his or her weight on the left handle 105, which is preferably in a horizontal position. The user then pivots the handle back toward the horizontal to lock the tongue into position with a rib 107 higher than the rib it was locked into before the upward motion. The user repeats this series of steps with his or her left hand and the handle 105 on the left side frame 13. The user repeats for both hands a number of times and ultimately is able to reach the lower handles 49 of the walker. The user may then work his or her hands up the walker along the smooth upwardly increasing section of the tube 23 from the lower handles 49 to the upper handles 35. In this manner, a user is able to raise him or herself from a seated position without the assistance of another person. When not in use, the handles 105 may be locked in place parallel to the leg portion 25 and at a ninety-degree angle to the central plane of the coupling member 104.

In a preferred embodiment, the tongue 109 includes a coupling face 115 that has a concave curvature to match the curvature of the leg portion 25. In this way, the tongue 109 can form a secure fit between the ribs 107 of the lower leg portion. In an alternative embodiment (not pictured), the climbing member 102 may be included not only on the leg portions 25 at the rear of the walker, but also on the front portions 23, 27 of the walker. When provided on the front leg portions, the climbing members 102 can be utilized to assist the user in rising from a seated position when he or she can access only the front portion of the walker. In yet another alternative embodiment, ribs 107 may be included along a larger portion of the tubing 23, for example, from near the bottom of leg member 25 to the portion 47 just before the handle section 35. In this way, the climbing members 102 may be utilized to assist a user to climb from a seated position all the way to a standing position with his or her hands on the handles 35. In a still further alternative embodiment, the ribs 107 may not extend all the way around the circumference of the leg portion 25, but rather may be limited to extend across only that part of the leg portion necessary to interact with the tongue 109 and support the weight of the user during use.

It is preferred that the tongue 109 is capable of retracting within the climbing members 102 during use so that the tongue 109 does not interfere with the ribs 107 while the climbing members 102 are moved along the ribs 107. This may be accomplished, for example, through the use of a button-activated 121 or lever-based tongue-retraction system placed on the climbing members 102. When a retractable tongue 109 is used, the climbing members 102 move more freely along the ribs 107.

Figure 9:
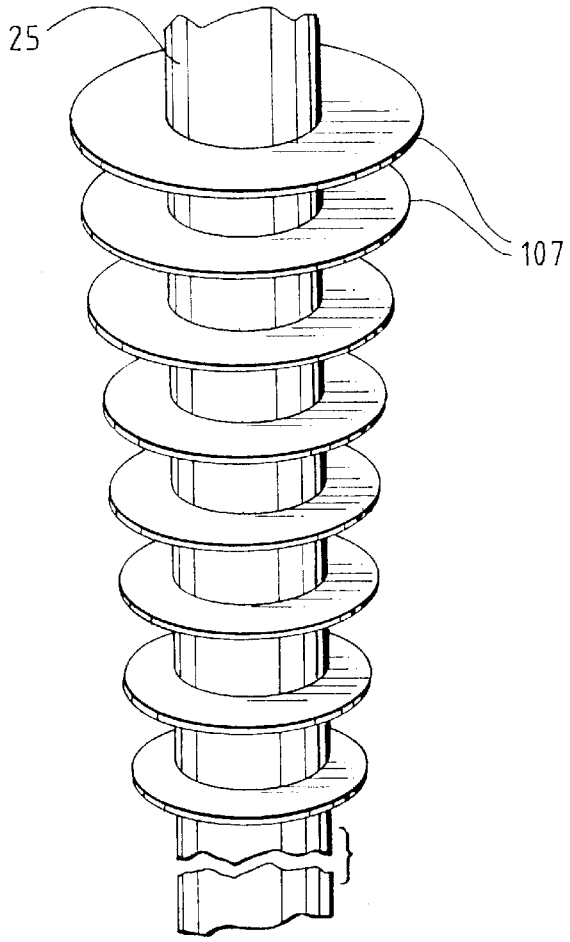
FIG. 9 is a perspective view of a leg portion and ribs according to a particular embodiment of the invention.
Figure 10:
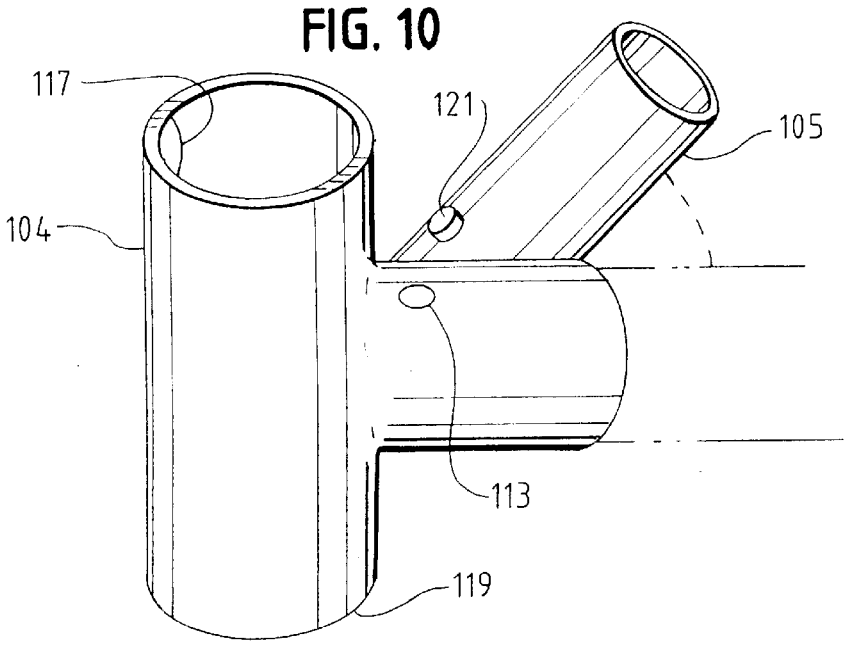
FIG. 10 is a perspective view of a climbing member according to a particular embodiment of the invention.

When in use, the coupling member 104 makes contact with the ribs 107 and/or leg members along two friction-contact points 117, 119. A rubber or relatively high-friction pad is preferably located at contact points 117, 119, as shown by the feature of the upper point 117. Such pads can help strengthen the user's grip and/or assist the user in creating leverage when using the members 102 to rise from a seated position. The ribs 107 may be radially extending, as shown in FIG. 9, or other suitable shape, such as, for example having a straight edge to interact with a flat surfaced coupling face on the tongue.

The climbing member 102 may be made from a suitable (preferably lightweight) metal or plastic (such as, for example, ABS or other durably hard, injection-moldable plastic). If the climbing member 102 is made from a plastic, it is may be made from a transparent plastic to allow the user to better visualize the tongue 109 interacting with the ribs 107. To this end, the ribs 107 may be bright or otherwise distinct in color to be visible to a user.

In a still further embodiment, the walker may include telescoping or retracting rear leg portions 25. The purpose for allowing the rear leg portions 25 to telescope or retract is to allow the walker to be used as an assistance device for climbing and descending stairs. For example, when descending stairs using the walker, the rear leg portions 25 could easily catch on the stairs behind (and therefore above) the user. With the leg portions telescoped, the user could descend stairs without such interference. In this manner, the walker operates with primarily just the arms, wristguards and front leg portions being utilized. As a result, the user may use the walker to climb and descend stairs. The telescoping may be effected, for example, through the use of a button-activated retraction, or a pivoting or lever-type retraction.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. A walker, comprising:

a left side frame having a front support end and a rear support end, each of said ends being of a size for making supporting contact with a floor, said ends being spaced apart, said left side frame having a hand grip portion;

a right side frame having a front support end and a rear support end, each of said ends being of a size for making supporting contact with a floor, said ends being spaced apart, said right side frame having a hand grip portion;

a rear crossbar having a first pivot joint pivotally connecting said left frame member to said rear crossbar and a second pivot joint pivotally connecting said right frame member to said rear crossbar; and a first climbing member slidably mounted along said at least one portion of said right side frame and a second climbing member slidably mounted along said at least one portion of said left side frame.

2. The walker of claim 1 wherein said pivot joints are adapted to permit both ipsolateral and contralateral use.

3. The walker of claim 1 wherein:

said left side frame extends, at a generally inclined angle with respect to vertical, between said first pivot joint and said left side hand grip portion; and said right side frame extends, at a generally inclined angle with respect to vertical, between said second pivot joint and said right side hand grip portion.

4. The walker of claim 1 further comprising:

supporting ribs extending along at least a portion of said right side frame and along at least a portion of said left side frame.

5. The walker of claim 4 wherein said supporting ribs are radially extending ribs and extend substantially the entire circumference of said right and left side frames.

6. The walker of claim 4 wherein said climbing members include:

a coupling member;

a handle member pivotally connected to said coupling member; and a retractable tongue member for selectively contacting said supporting ribs.

7. The walker of claim 1 wherein portions of said frames adjacent said rear support ends are retractable for climbing or descending stairs.

8. The walker of claim 1 wherein portions of said frames adjacent said rear support ends telescope for climbing or descending stairs.

9. A walker, comprising:

a left side frame having a front support end and a rear support end, each of said ends being of a size for making supporting contact with a floor, said ends being spaced apart, said left side frame having a hand grip portion;

a right side frame having a front support end and a rear support end, each of said ends being of a size for making supporting contact with a floor, said ends being spaced apart, said right side frame having a hand grip portion;

a crossbar connecting said left frame member to said right frame member; and a first climbing member slidably mounted along said at least one portion of said right side frame and a second climbing member slidably mounted along said at least one portion of said left side frame.

10. The walker of claim 9 wherein said crossbar comprises a rear crossbar having a first pivot joint pivotally connecting said left frame member to said rear crossbar and a second pivot joint pivotally connecting said right frame member to said rear crossbar.

11. The walker of claim 10 wherein said pivot joints are adapted to permit both ipsolateral and contralateral use.

12. The walker of claim 9 wherein:

said left side frame extends at a generally inclined angle with respect to vertical between said first pivot joint and said left side hand grip portion; and said right side frame extends at a generally inclined angle with respect to vertical between said second pivot joint and said right side hand grip portion.

13. The walker of claim 9 further comprising:

a supporting ribs extending along at least a portion of said right side frame and along at least a portion of said left side frame.

14. The walker of claim 13 wherein said supporting ribs are radially extending ribs and extend substantially the entire circumference of said right and left side frames.

15. The walker of claim 13 wherein said climbing members include:

a coupling member;

a handle member pivotally connected to said coupling member; and a retractable tongue member for selectively contacting said supporting ribs.

16. The walker of claim 9 wherein portions of said frames adjacent said rear support ends are retractable for climbing or descending stairs.

17. The walker of claim 9 wherein portions of said frames adjacent said rear support ends telescope for climbing or descending stairs.

* * * * *